US006884053B2

(12) United States Patent
Day

(10) Patent No.: US 6,884,053 B2
(45) Date of Patent: Apr. 26, 2005

(54) APPARATUS FOR PRODUCING A MULTIFILAMENT YARN FROM A THERMOPLASTIC POLYMER

(75) Inventor: Nicholas Day, Eschwege (DE)

(73) Assignee: Georg Sahm GmbH & Co. KG (DE)

( * ) Notice: Subject to any disclaimer, the term of this patent is extended or adjusted under 35 U.S.C. 154(b) by 307 days.

(21) Appl. No.: 10/154,167

(22) Filed: May 23, 2002

(65) Prior Publication Data

US 2002/0175433 A1 Nov. 28, 2002

(30) Foreign Application Priority Data

May 25, 2001 (DE) ..... 101 25 480

(51) Int. Cl.[7] ..... D01D 5/096

(52) U.S. Cl. ..... 425/66; 425/72.2; 425/135; 425/140; 425/150; 425/377; 425/382.2

(58) Field of Search ..... 425/66, 72.2, 140, 425/135, 150, 464, 377, 382.2; 264/40.1, 211.12, 211.14

(56) References Cited

U.S. PATENT DOCUMENTS 5,928,579 A * 7/1999 Spahlinger et al. ..... 264/40.1
6,002,472 A * 12/1999 Naka et al. ..... 356/73.1
6,110,403 A * 8/2000 Binner et al. ..... 264/40.1

FOREIGN PATENT DOCUMENTS

| | | | |
|---|---|---|---|
| DE | 3708331 | C1 | 7/1988 |
| DE | 42 24 453 | A1 | 2/1993 |
| DE | 19716394 | C1 | 9/1998 |
| DE | 199 11 704 | A1 | 10/1999 |
| EP | 0 881 185 | A1 | 12/1998 |
| EP | 0957187 | A2 | 5/1999 |
| JP | 0 580 071 | A2 | 1/1994 |
| WO | WO 94/25869 | A2 | 11/1994 |

OTHER PUBLICATIONS

Franz Fourné, "Synthestische Fasern", Jan. 26, 1996.

* cited by examiner

*Primary Examiner*—Joseph S. Del Sole
(74) *Attorney, Agent, or Firm*—Thomas, Kayden, Horstemeyer & Risley, LLP

(57) ABSTRACT

An apparatus for producing a multifilament yarn from a thermoplastic polymer includes a yarn guiding element being movable in a vertical direction. A drive serves to change the vertical position of the yarn guiding element with respect to a point of consolidation of the filaments. At least one sensor senses the yarn tension of the filaments. A control unit serves to control the drive in response to the sensed yarn tension to change the vertical position of the yarn guiding element.

16 Claims, 4 Drawing Sheets

APPARATUS FOR PRODUCING A MULTIFILAMENT YARN FROM A THERMOPLASTIC POLYMER

CROSS REFERENCE TO RELATED APPLICATIONS

This application claims the benefit of co-pending German Patent Application No. 101 25 480.6-26 entitled "Verfahren und Vorrichtung zur Herstellung eines Multifilament-Garns aus einem thermoplastischen Polymer", filed on May 25, 2001.

FIELD OF THE INVENTION

The present invention generally relates to a method and an apparatus of producing filaments from a thermoplastic material. More particularly, the present invention relates to a method and an apparatus of producing a multifilament yarn. The multifilament yarn may be produced from single filaments and from microfilaments, respectively. Preferably, the filaments are produced by melt extrusion or melt-spinning, and they are combined by a yarn guiding element to form a multifilament yarn.

BACKGROUND OF THE INVENTION

A method and an apparatus for producing microfilament yarns are known from European Patent Application No. 0 957 187 A2 and from corresponding U.S. Pat. No. 6,174,474. Filaments are produced by melt-spinning or in other words by melt extrusion with a spinning velocity of 2000 to 7000 m/min. A central loading system—meaning one that loads air from the inside of a so called blowing candle—serves to cool the filaments. The tempered cooled air is fed from the outside towards the inside, and it streams towards the outside inside the bunch of filaments. The cooling unit from which the tempered air streams has an effective cooling length which may be varied. It is important to the known apparatus that the user is capable of adjusting the distance of the upper end of the cooling unit with respect to the injector plate. Depending on the titer, the distance is adjusted to reach a maximum of 35 mm. The filaments are separately guided by an annular yarn guiding element, and they are combined by another yarn guiding element being arranged below the cooling unit. The second yarn guiding element is designed to be movable in a vertical direction. The vertical position of the yarn guiding element is varied in response to the design and arrangement of the blowing candle. The relative position of the point of consolidation of the filaments is not changed, and it depends on other values, for example on the temperature of the polymer in the region of the injector plate, and especially on the drawing-off velocity and the production velocity, respectively, as well as on the efficiency of the cooling apparatus. The position of the point of consolidation also depends on many other factors, for example on the type of the used polymer, its components, especially its colors, the titer of the filaments, the entire titer of the multifilament yarn, the desired properties of the yarn and the spinning velocity to only mention the most important influencing variables.

SUMMARY OF THE INVENTION

The present invention relates to a method of producing a multifilament yarn from a thermoplastic polymer. The method includes the steps of producing a majority of fluid filaments by melt-extrusion, cooling the fluid filaments to at least partly harden at a point of consolidation, guiding the hardened filaments by a yarn guiding element, sensing the tension of the hardened filaments, varying the distance between the yarn guiding element and the point of consolidation by moving the yarn guiding element in a vertical direction in response to the sensed tension, and combining the majority of hardened filaments to form at least one multifilament yarn. The present invention also relates to a novel apparatus for conducting the novel method of producing a multifilament yarn from a thermoplastic polymer.

The novel method and apparatus may be used when one first produces molten filaments. The range of transition between the molten phase and the at least partly hardened phase of the filaments is called the point of consolidation or the hardening point. The produced multifilament yarns may be used for technical purposes, but also for further textile processing. When one or more galette units are used, the multifilament yarn may be produced with a great value of evenness of the diameter over the length of the filaments (the so called "Uster" value). The multifilament yarn may be produced with low orientation, partial orientation, or at fully stretched condition. The novel method and apparatus may be used independent from the type of cooling. For example, they may be used in combination with a traverse cooling system, an inner cooling system, or a cooling system using environmental air. The novel method and apparatus are capable of producing filaments and microfilaments, respectively, having a fineness of less than approximately 1 dtex per filament. When producing a multifilament yarn, up to approximately 200 filaments or more may be combined to form the multifilament yarn.

With the novel method and apparatus, it is possible to adapt to the conditions of different products to be produced in a simple and quick way, and to produce these different products at constant, uniform textile-mechanical properties.

The novel method and apparatus take into account that yarn tension varies in response to a variation of the position of the point of consolidation of the filaments with respect to the injector plate and with respect to a yarn guiding element. Consequently, from a variation of the yarn tension, it may be concluded to the position of the point of hardening. By sensing and measuring the yarn tension either of the filaments upstream of the point of combination to form the multifilament yarn, or of the multifilament yarn after the point of combination of the filaments, a signal may be derived. The signal serves to control and determine, respectively, the relative position of the yarn guiding element, especially of the first yarn guiding element of a plurality of yarn guiding elements being located directly downstream of the point of hardening. It is taken into account that especially the textile-mechanical properties of the multifilament yarn strongly depend on the distance between the point of hardening and the first frictional contact of the separate filaments and of the multifilament yarn, respectively, with a yarn guiding element. This applies no matter whether the yarn guiding element only serves to guide the filaments and/or the multifilament yarn, or to also prepare the filaments and/or the multifilament yarn.

The novel method may be conducted during a change of the product which usually takes place without stopping the melt-spinning process, as well as during the production of a certain product. Especially, it is used to keep the textile-mechanical properties of the respective product as constant as possible.

Determining, sensing or measuring the yarn tension may be conducted in a clocked manner, meaning in predetermined or adjustable period of times. Accordingly, controlling or adjusting the distance of the yarn guiding element with respect to the point of consolidation may also be achieved in a clocked manner.

However, it is especially preferred to continuously sense and measure the yarn tension, and to change the distance of the yarn guiding element with respect to the point of consolidation in response to the sensed yarn tension in a clocked manner. Continuously sensing the yarn tension makes it possible to quickly and promptly, respectively, determine a change of the textile-mechanical properties. Clocked control of the relative distance with respect to the point of consolidation results in useful times during which the yarn guiding element is not moved. In this way, continuous movement of the yarn guiding element up and down is prevented, and movement only occurs when it makes sense to attain constant properties.

Furthermore, it makes sense to sense the yarn tension directly downstream of the first yarn guiding element downstream of the injector plate. The place where the tension is sensed preferably is located close to the yarn guiding element of which the vertical position is to be changed to be capable of sensing and determining the change of the position of the hardening point free from other influences occurring in a downstream region. However, it seems to be also possible to sense the yarn tension directly upstream of the first yarn guiding element following the injector plate.

The yarn tension may also be sensed at a plurality of places downstream of the first yarn guiding element after the injector plate, and the distance of the yarn guiding element may be varied in accordance with an average value of the sensed values. Determining an average value may be conducted in an arithmetic way. However, the different values may also be weighted differently. Usually, the signal of the sensor having the smallest distance with respect to the point of hardening is of special importance. However, it is also possible to derive signals of a plurality of galette units, and to also use these signals for the control signal controlling the drive of the yarn guiding element.

The variation in yarn tension due to traversing movements during winding of the multifilament yarn may be dampened in an upstream direction by a great triangle of placement. Such a great triangle of placement may be attained by arranging a head yarn guiding element upstream of the traversing unit and to have an especially great distance with respect to the traversing unit, or at least being movable to reach such an operating position.

The novel apparatus for producing a multifilament yarn from a thermoplastic polymer includes an injector plate being designed and arranged to produce filaments from a thermoplastic polymer. At least one yarn guiding element is designed and arranged to be movable in a vertical direction. A drive is designed and arranged to change the vertical position of the at least one yarn guiding element with respect to a point of consolidation of the filaments. At least one sensor is designed and arranged to sense and determine the yarn tension of the filaments. A control unit is designed and arranged to control the drive in response to the sensed yarn tension to change the vertical position of the at least one yarn guiding element. A unit serves wind up the multifilament yarn to form a bobbin of multifilament yarn.

In the novel apparatus, the yarn guiding element is not connected to the apparatus by a screw connection or the like in a way to manually change its vertical position. Instead, the novel apparatus includes a drive to which the yarn guiding element is operatively connected. The drive serves to change the position of the yarn guiding element with respect to the point of hardening of the filaments, and consequently with respect to the position of the injector plate, during operation of the apparatus in a continuous progressive way. Such a drive may be realized in many different ways, for example, in a mechanical way by a motor-driven adjustment spindle or in a pneumatic or hydraulic way by using respective piston and cylinder units and the like.

The apparatus at least includes one sensor for sensing and determining the yarn tension. Such sensors serving to determine yarn tensions are known in the art, and further description is therefore nor required. However, the sensor of the novel apparatus is arranged in the path of the filaments or of the multifilament yarn, and it is preferably commonly moved with the yarn guiding element such that the relative distance between the yarn guiding element and the sensor remains unchanged. The apparatus furthermore includes a control unit being designed and arranged to control the drive in response to the sensed yarn tension sensed by the sensor. The unit is designed and arranged to process and modulate the signal delivered by one or more sensors, and to transmit the signal to the drive. To attain a closed control loop, it is also possible to watch the actual movement of the yarn guiding element with respect to the point of hardening to realize an especially suitable distance between the point of consolidation and the yarn guiding element for the respective product to be produced.

The yarn guiding element may be designed and arranged to form a multifilament yarn. The sensor may be located directly downstream of the yarn guiding element. It is preferred to arrange the sensor close to the yarn guiding element. It is to be understood that in all exemplary embodiments the apparatus may include a plurality of yarn guiding elements of which the vertical position may be changed. Preferably, the plurality of yarn guiding elements are designed and arranged to be commonly moved by one common drive. It is also advantageous when the yarn guiding element and the sensor are designed and arranged to be commonly moved in a vertical direction by the drive. In such a case, when changing the vertical position, only the distance with respect to the point of consolidation changes, but not the relative distance between the yarn guiding element and the sensor.

Furthermore, it is also possible that the yarn guiding element as well serves to prepare the filaments and/or the multifilament yarn. In this way, the yarn guiding element may only guide the filaments. However, the yarn guiding element may also be designed and arranged to only guide the multifilament yarn. Combined designs are also possible, for example designs by which a spinning oil or a different preparational fluid is applied.

Furthermore, it is advantageous when the apparatus includes a head yarn guide or a galette unit being arranged to be movable. In this way, there is the possibility of realizing a comparatively great triangle of placement during operation such that the changes of yarn tension resulting from the traversing movement during winding remain comparatively small, and they are only introduced in a dampened way in a direction opposite to the direction of movement of the multifilament yarn, respectively. Consequently, there is no substantial negative influence of the process of determining the yarn tension by the sensor.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
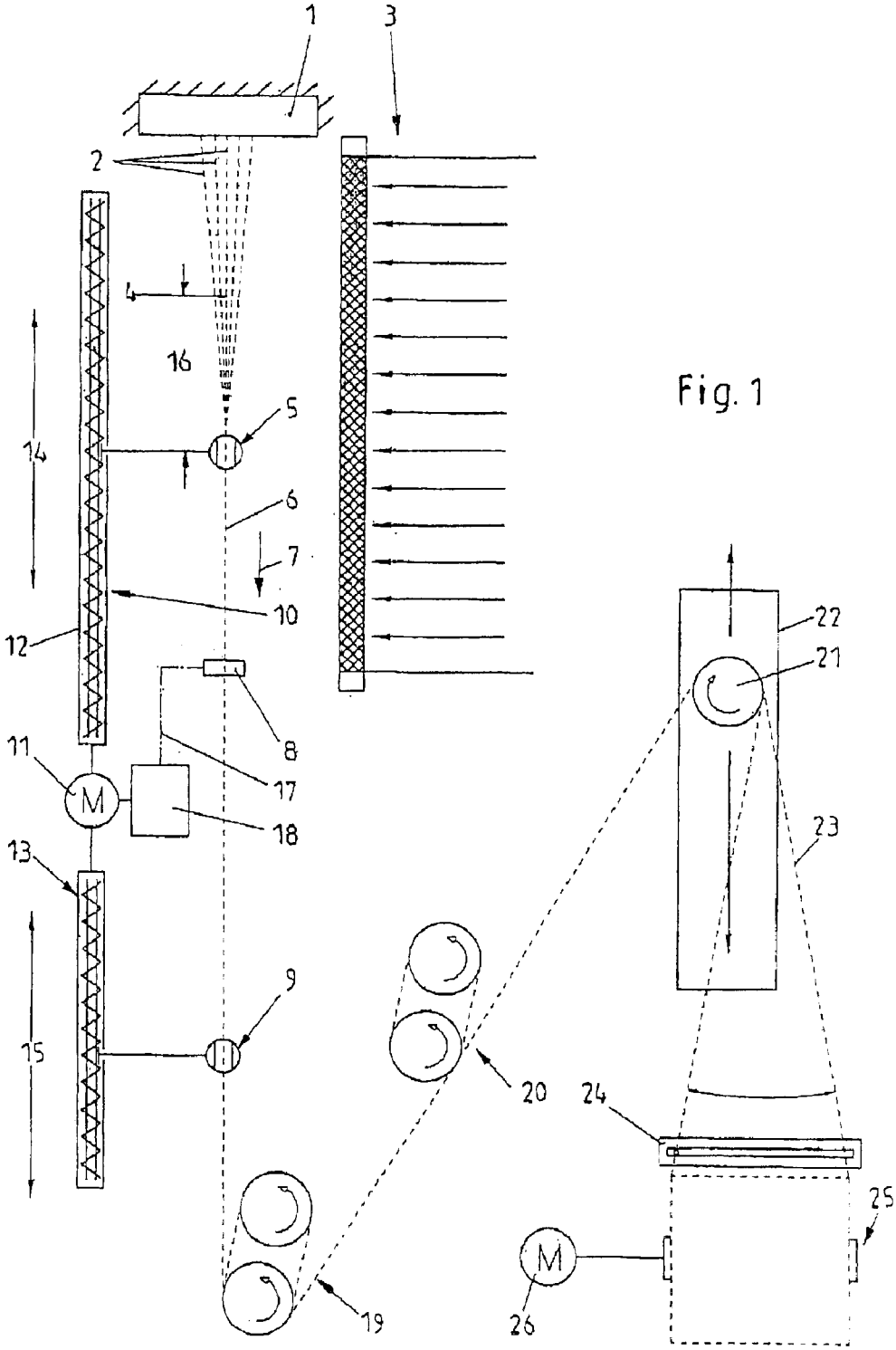
FIG. 1 is a schematic view of elements of a first exemplary embodiment of the novel apparatus for producing a multifilament yarn.

Referring now in greater detail to the drawings, FIG. 1 schematically illustrates an exemplary embodiment of the novel apparatus producing a multifilament yarn. The apparatus includes a spinning system including an injector plate 1. A majority of filaments 2 exit from the injector plate 1 in fluid condition and spaced apart with respect to one another. For example, there may be approximately 200 to approximately 400 filaments 2. The exiting filaments 2 are still liquid or pasty, and they will be later cooled in some way.

The illustrated exemplary embodiment of the novel apparatus of FIG. 1 includes a transverse cooling apparatus 3 with which cool air is blown from the outside through the bunch of filaments 2. During the downward movement of the filaments 2, they at least partially harden in the region of their outer surfaces. In this way, there is a point of consolidation 4 which is located approximately at the same distance with respect to the injector plate 1 for all filaments 2. The separate filaments 2 are later combined to form a multifilament yarn 6. This is done by a yarn guiding element 5. The multifilament yarn 6 then moves in a downward direction, and it is pulled off in this direction, respectively, according to arrow 7. During this process, tension occurs in the multifilament yarn 6. There is a sensor 8 being designed and arranged to sense and determine the yarn tension. The drawn-off multifilament yarn 6 moves through another additional yarn guiding element 9 being located below and downstream, respectively, of the sensor 8. The two yarn guiding elements 5 and 9 are designed and arranged to be commonly movable to change their heights—or in other words their vertical positions—whereas the sensor 8 is designed and arranged to be stationary. A drive 10 serves to move the yarn guiding elements 5 and 9 in a vertical direction. The drive 10 includes an engine or a motor 11 by which two threaded spindles 12 and 13 are rotated. The yarn guiding element 5 is connected to a nut of the threaded spindle 12 such that its vertical position may be changed when rotating the motor 11 and the threaded spindle 12, respectively, according to double arrow 14. Correspondingly, the yarn guiding element 9 being operatively coupled to the threaded spindle 13 is moved in a vertical direction according to double arrow 15. This change of height also is a change of a distance 16 between the consolidation point 4 and the yarn guiding element 5. The threaded spindles 12 and 13 may also have different angles of inclination to realize an influence on the relative position of the yarn guiding elements 5 and 9 with respect to one another. However, the distance 16 between the point of consolidation 4 and the filaments 2 and a starting position of the yarn guiding element 5 may be controlled.

When the yarn tension of the multifilament yarn 6 sensed by the sensor 8 changes, there is a changing signal which is transmitted to a control unit 18 by a line 17. The control unit 18 processes the signal, it modulates the signal, or it has a different desired influence on the signal. The motor 11 is then controlled by the control unit 18 to change the vertical position of the yarn guiding element 5 with respect to the hardening point 4 when desired.

The multifilament yarn 6 after having passed through the second yarn guiding element 9 contacts a first galette element 19 and a second galette element 20 in which it is treated in a usual way, for example to be lengthened. Each galette element 19, 20 includes two rollers. Additionally, a roller 21 is arranged downstream of the galette elements 19, 20. The roller 21 is located on a slide element 22 to be commonly moved up and down in a vertical direction. To reach a changing position, the roller 21 is moved in a downward direction. In the operating position, the roller 21 is located at a higher position to realize a comparatively great triangle of placement between the roller 21 and a traversing apparatus 24. The multifilament yarn 6 is then wound up by a winding unit 25 including a motor 26 to form a bobbin. The triangle of placement 23 is chosen to be great to realize preferably low changes in yarn tension resulting from the traversing movement of the multifilament yarn 6, and to realize preferably low influence of these changes in yarn tension onto the determination of the yarn tension by the sensor 8.

Figure 2:
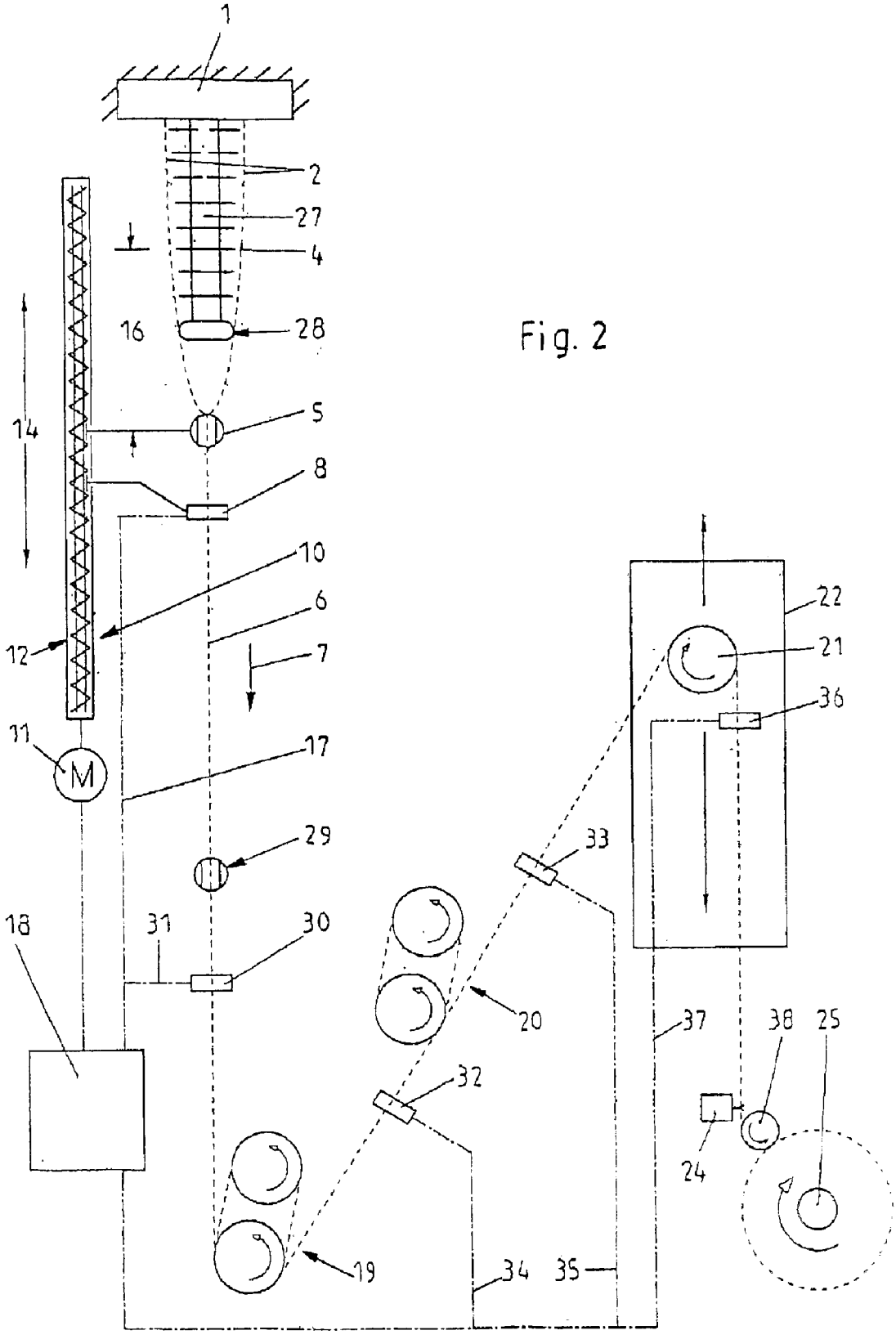
FIG. 2 is a schematic view of elements of a second exemplary embodiment of the novel apparatus for producing a multifilament yarn.

The exemplary embodiment of the novel apparatus as illustrated in FIG. 2 has a lot in common with the apparatus as illustrated in FIG. 1. However, in this case, a blow candle 27 is fixedly connected to the injector plate 1. The blow candle 27 includes a tube having openings. Cool air streams through these openings from the inside towards the outside in a radial direction and through the bunch of filaments 2. A yarn guiding member 28 is located at the stationary end of the blow candle 27. The hardened filaments 2 are guided at the yarn guiding member 28. The yarn guiding member 28 may be designed as a preparational yarn guiding element. The distance between the yarn guiding member 28 and the hardening point 4 cannot be actively adjusted since the blow candle 27 and the yarn guiding member 28 are arranged to be stationary.

Again, the filaments 2 are being led together at a yarn guiding element 5. The yarn guiding element 5 is again connected to the drive 10 and to the threaded spindle 12, respectively, to be moved in a vertical direction. The sensor 8 for sensing and determining the yarn tension is located directly below the yarn guiding element 5. The sensor 8 is arranged to be movable by being coupled to the drive 10. The distance between the yarn guiding element 5 and the sensor 8 preferably is constant. Again, the yarn guiding element 5 is moved with respect to the hardening point 4 to change the distance 16 with respect to the hardening point 4. Further downstream of the multifilament yarn 6, there is a stationary yarn guiding element 29 and even further downstream another stationary sensor 30. A line 27 leads from the sensor 8 to the control unit 18. A line 31 leads from the sensor 30 to the control unit 18. Additional stationary sensors 32 and 33 are located in the region of the galette elements 19, 20, 21, and they are also connected to the control unit 18 by electric lines 34 and 35, respectively. Another stationary sensor 36 is located downstream of the roller 21. The sensor 36 is connected to the control unit 18 by a line 37. In this way, the yarn tension signals sensed and determined by the sensors 8, 30, 32, 33 and 36 are processed in the control unit 18, and a respective control signal is transmitted to the motor 11 of the drive 10 such that the vertical position of the yarn guiding element 5 and of the sensor 8 are changed when the yarn tension has changed. For this purpose, the distance 16 with respect to the point of consolidation 4 is changed and adjusted, respectively. The position of the point of consolidation 4 may also vary during a variation of production conditions. The winding element 25 being arranged downstream includes a contact roller 38. The incoming signals are processed in the control unit 18, and they are being sent to the motor 11 to control the motor 11. Preferably, the signals have been filtered and weighted. The yarn tension may be continuously sensed, and the vertical position of the yarn guiding element 5 and of the sensor 8 may be changed in a clocked manner and in a stepwise manner, respectively.

Figure 3:
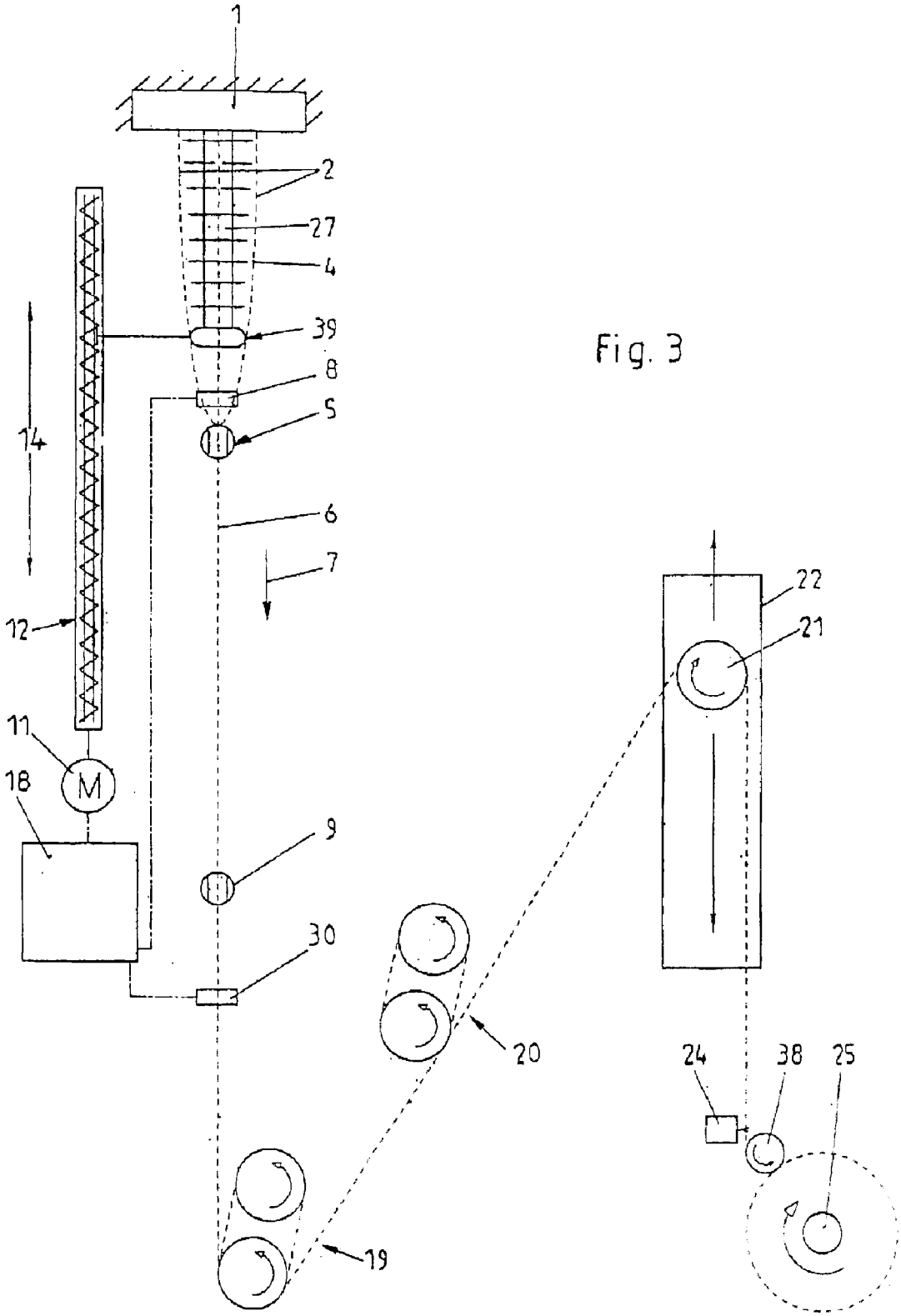
FIG. 3 is a schematic view of elements of a third exemplary embodiment of the novel apparatus for producing a multifilament yarn.

In the exemplary embodiment of the novel apparatus as illustrated in FIG. 3, the blow candle 27 is not connected to the injector plate 1 in a stationary manner, but instead it is connected to the threaded spindle 12 to be movable in a vertical direction. The lower end of the blow candle 27 includes a yarn guiding element 39 the distance of which with respect to the point of consolidation 4 may be controlled to change the vertical position. A first sensor 8 and a second sensor 30 are arranged to be stationary. The yarn guiding element 5 and the yarn guiding element 9 are arranged to be stationary. For additional details of the apparatus as illustrated in FIG. 3, it is referred to the above description of FIG. 2. Instead of a blow candle 27 having a fixed effective length, it is also possible to use a blow candle 27 having a variable effective length the upper end of which is connected to the injector plate 1.

Figure 4:
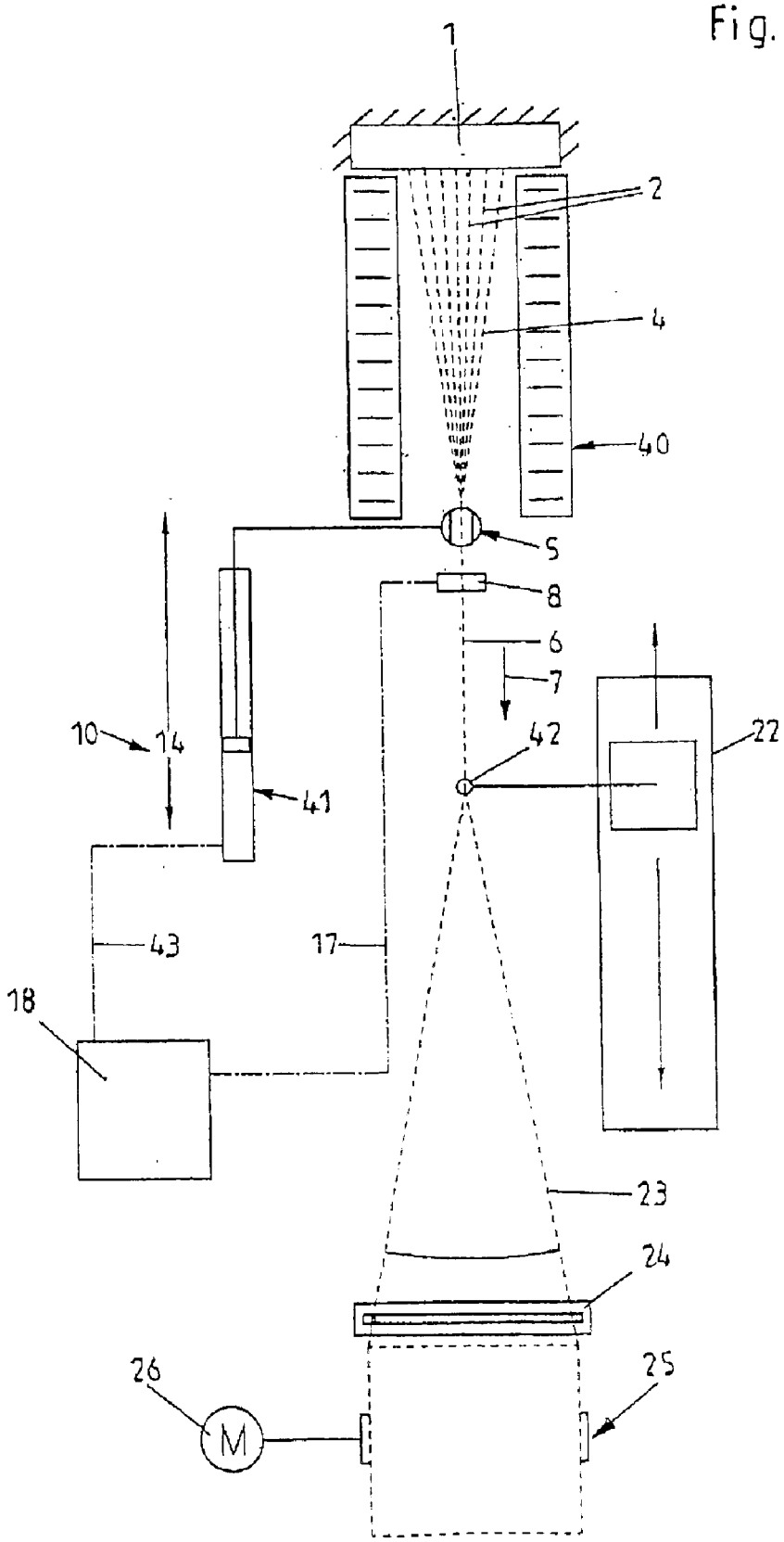
FIG. 4 is a schematic view of elements of a fourth exemplary embodiment of the novel apparatus for producing a multifilament yarn.

In the exemplary embodiment of the novel apparatus as illustrated in FIG. 4, the bunch of filaments 2 is surrounded by a cooling apparatus 40 having an annular design with which cool air is blown through the bunch of filament 2 in a radial direction from the outside towards the inside. The yarn guiding element 5 is guided with respect to the hardening point 4. The yarn guiding element 5 is designed to change is vertical position by the drive 10. The drive 10 includes at least one piston and cylinder unit 41 with which the vertical position of the yarn guiding element 5 may be changed. A respective signal of yarn tension is transmitted from a stationary sensor 8 to the control unit 18. In this exemplary illustrated embodiment of the novel apparatus, there are no gallete elements. Instead, a head yarn guiding element 42 is located in a direct line from the upper side to the lower side. The element 42 is carried by the slide element 22, and it is arranged to be movable in a vertical direction to enlarge and reduce, respectively, the triangle of placement 23. A winding element 25 and a traversing apparatus 24 are also included in the novel system. A control signal is transmitted from the control unit 18 to the piston and cylinder unit 41 by a line 43. The yarn guiding element 5 may also have the design of a preparational yarn guiding element.

Many variations and modifications may be made to the preferred embodiments of the invention without departing substantially from the spirit and principles of the invention. All such modifications and variations are intended to be included herein within the scope of the present invention, as defined by the following claims.

I claim:

1. An apparatus for producing a multifilament yarn from a thermoplastic polymer, comprising:

an injector plate being designed and arranged to produce filaments from a thermoplastic polymer;

at least one yarn guiding element, said at least one yarn guiding element being designed and arranged to be movable in a vertical direction;

a drive being designed and arranged to change the vertical position of said at least one yarn guiding element with respect to a point of consolidation of the filaments;

at least one sensor being designed and arranged to sense and determine the yarn tension of the filaments;

a control unit being designed and arranged to control said drive in response to the sensed yarn tension to change the vertical position of said at least one yarn guiding element; and a unit for winding the multifilament yarn.

2. The apparatus of claim 1, wherein said yarn guiding element is designed and arranged to form the multifilament yarn, and wherein said sensor is arranged directly downstream of said yarn guiding element.

3. The apparatus of claim 1, wherein said yarn guiding element and said sensor are designed and arranged to commonly change their vertical position by said drive.

4. The apparatus of claim 2, wherein said yarn guiding element and said sensor are designed and arranged to commonly change their vertical position by said drive.

5. The apparatus of claim 1, wherein said yarn guiding element is designed and arranged to prepare the filaments.

6. The apparatus of claim 2, wherein said yarn guiding element is designed and arranged to prepare the multifilament yarn.

7. The apparatus of claim 3, wherein said yarn guiding element is designed and arranged to prepare the filaments.

8. The apparatus of claim 4, wherein said yarn guiding element is designed and arranged to prepare the filaments.

9. The apparatus of claim 1, further comprising a head yarn guiding element, said head yarn guiding element being designed and arranged to be movable.

10. The apparatus claim 1, further comprising a galette element, said galette element being designed and arranged to be movable.

11. An apparatus for producing multifilament yarn from a thermoplastic polymer, comprising:

a unit being designed and arranged to produce at least partly fluid filaments from a thermoplastic polymer;

a cooling unit being designed and arranged to cool the at least partly fluid filaments to at least partly harden at a point of consolidation;

at least one yarn guiding element being designed and arranged to be movable in a vertical direction;

a drive being designed and arranged to change the vertical position of said at least one yarn guiding element with respect to the point of consolidation of the filaments;

at least one sensor being designed and arranged to sense and determine the yarn tension of the filaments; and a control unit being designed and arranged to control said drive in response to the sensed yarn tension to change the vertical position of said at least one yarn guiding element.

12. The apparatus of claim 11, wherein said yarn guiding element is designed and arranged to form the multifilament yarn by combining the filaments, and wherein said sensor is arranged directly downstream of said yarn guiding element to sense the yarn tension of the filaments forming the multifilament yarn.

13. The apparatus of claim 11, wherein said yarn guiding element and said sensor are designed and arranged to commonly change their vertical position by said drive.

14. The apparatus of claim 11, wherein said yarn guiding element is designed and arranged to prepare the filaments.

15. The apparatus of claim 11, further comprising a head yarn guiding element, said head yarn guiding element being designed and arranged to be movable.

16. The apparatus of claim 11, further comprising a galette element, said galette element being designed and arranged to be movable.

* * * * *